US005597229A

United States Patent [19]

Plichta et al.

[11] Patent Number: 5,597,229

[45] Date of Patent: Jan. 28, 1997

[54] MULTIPURPOSE COUPLING FOR CONNECTING DECORATIONS TO A STAKE

[75] Inventors: Wojtek Plichta, Toronto; Ivan Liu, Ontario, both of Canada; Charles W. Fennessy, Lemont; Frank Lang, Warrenville, both of Ill.

[73] Assignee: Noma Inc., Canada

[21] Appl. No.: 417,923

[22] Filed: Apr. 6, 1995

[51] Int. Cl.[6] ..... F21S 1/10

[52] U.S. Cl. ..... 362/153.1; 362/396; 362/431; 362/807

[58] Field of Search ..... 362/153, 153.1, 362/122, 226, 431, 807, 396, 806

[56] References Cited

U.S. PATENT DOCUMENTS

| | | | |
|---|---|---|---|
| 3,866,034 | 2/1975 | Russo | 362/431 |
| 4,725,929 | 2/1988 | Huang | 362/226 |
| 4,768,139 | 8/1988 | Poppenheimer | 362/302 |
| 4,774,648 | 9/1988 | Kakuk et al. | 362/431 |
| 4,996,636 | 2/1991 | Lovett | 362/431 |
| 5,036,447 | 7/1991 | Taylor | 362/431 |
| 5,178,454 | 1/1993 | Lai | 362/153 |
| 5,280,417 | 1/1994 | Hall et al. | 362/226 |

FOREIGN PATENT DOCUMENTS

| | | | |
|---|---|---|---|
| 83303 | 1/1954 | Norway | 362/807 |
| 1126925 | 9/1968 | United Kingdom . | |
| 2161595 | 1/1986 | United Kingdom . | |

*Primary Examiner*—Denise L. Gromada
*Assistant Examiner*—Alan B. Cariaso
*Attorney, Agent, or Firm*—Kirschstein et al.

[57] ABSTRACT

A decorative lighting arrangement includes a support, especially a stake driven into the ground, and a lighting fixture including a socket and a light bulb mounted in the socket. A coupling connects the lighting fixture to the support so that the light bulb and at least a predominant portion of the socket are disposed upwardly of an upper region of the support to be visible thereat.

10 Claims, 2 Drawing Sheets

FIG. 4
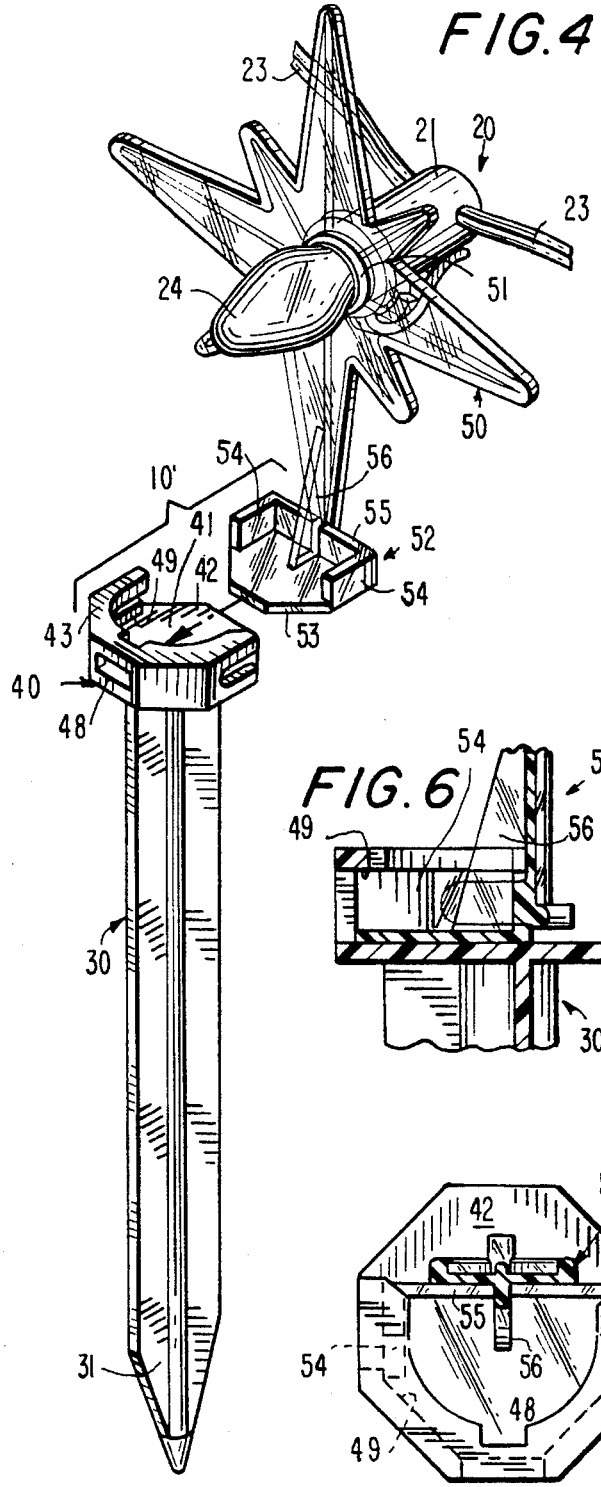
FIG. 5
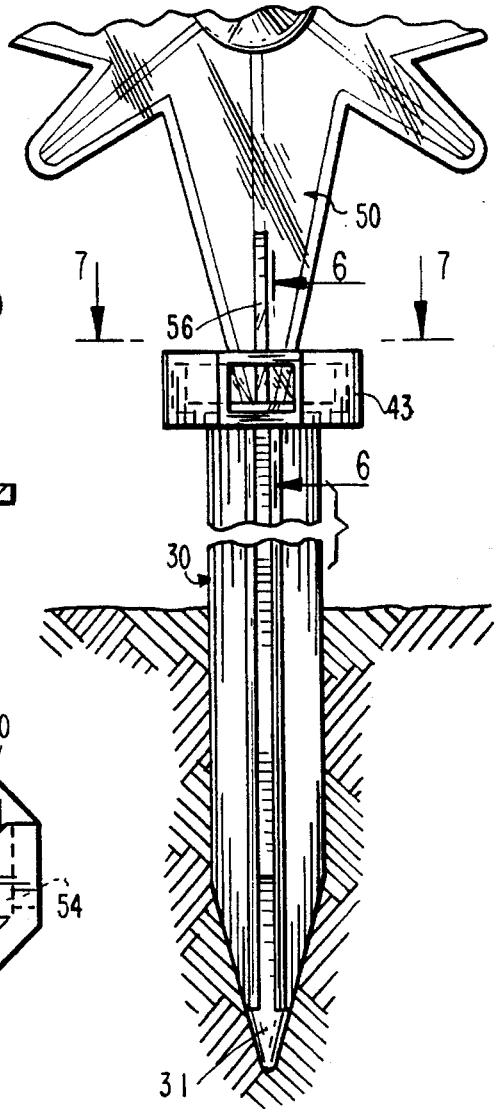
FIG. 6
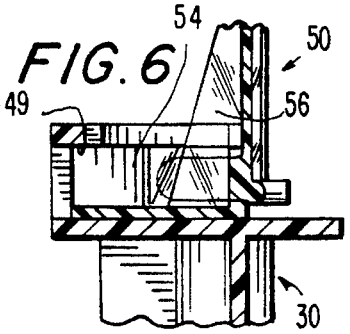
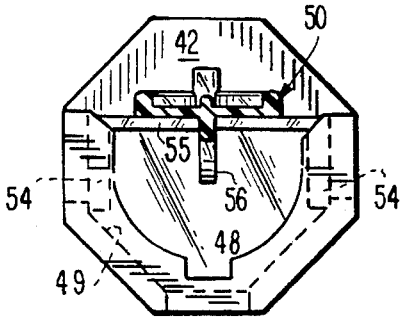
FIG. 7

MULTIPURPOSE COUPLING FOR CONNECTING DECORATIONS TO A STAKE

BACKGROUND OF THE INVENTION

1. Field of the Invention

The present invention relates to decorative lighting in general, and more particularly to the coupling of a lighting fixture to a support.

2. Description of the Related Art

There are already known various constructions of lighting fixtures and of arrangements for supporting the same in a selected position at any chosen location. One previously proposed structure of this kind is disclosed in the U.S. Pat. No. 5,036,447 to Taylor, wherein a stake to be driven into the ground is provided at its above-ground trailing end portion with a casing that fully accommodates the socket of the lighting fixture. The casing has a lateral aperture through which the socket is introduced into the interior of the casing, and a pair of slot-like cutouts that open into this aperture and are positioned and dimensioned for very loosely receiving the electrical wires that are connected to the socket.

One disadvantage of this known arrangement is that the casing substantially hides the socket from view, so that only the light bulb whose base is threaded into the socket through an access opening is visible above the casing. While this is consistent with the widely held perception that lighting arrangements of this kind have to be reminiscent to the greatest possible extent of candles in order to invoke the desired festive mood, experience has shown that such a pretense is unacceptable to many people or at least considered unnecessary by them.

Another disadvantage is that the stake is capable of cooperating or supporting only that kind of lighting fixture for which it has been designed and no other. Yet, there is often a desire to intersperse lighting fixtures of one kind with those of another kind in a series or row of such fixtures. This is impossible to do when the stake is incapable of supporting such different lighting fixtures.

On the other hand, there are also known various arrangements for coupling and/or latching various detachable elements, for example toothbrushes, to supports in the form of handles, or of devices for driving or vibrating such detachable elements. Examples of coupling arrangements of this sort can be found in U.S. Pat. No. 3,256,031 to Fillweber; U.S. Pat. No. 4,416,040 to Towsley; and U.S. Pat. No. 4,850,735 to Hansen, et al. None of these references suggests that the coupling arrangements disclosed therein could or should be used in conjunction with lighting fixtures and, in any event, very substantial modifications would be needed before the principles disclosed there could be used in such an application.

Moreover, star-shaped articles for decorative or other uses are disclosed, for instance, in the U.S. Pat. No. 1,910,247 to Heltzel, U.S. Pat. No. 3,663, 342 to Landwehr, and U.S. Pat. No. 3,604,367 to Korb. Only the latter reference discloses the use of lights in conjunction with a star-shaped structure, but only in the context of placing a multitude of lights on a frame of that configuration.

OBJECTS OF THE INVENTION

Accordingly, it is a general object of the present invention to avoid the disadvantages of the prior art.

More particularly, it is an object of the present invention to provide a decorative lighting arrangement which does not possess the drawbacks of the known arrangements of this type.

Still another object of the present invention is to devise a coupling for an arrangement of the type here under consideration that permits the mounting of more than one kind of lighting fixture on a support.

It is yet another object of the present invention to design the above coupling in such a manner as to securely hold the lighting fixture in position even though in engagement with substantially less than the entire electric socket of the fixture.

A concomitant object of the present invention is so to construct the lighting arrangement of the above type and its coupling as to be relatively simple in construction, inexpensive to manufacture, easy to use, and yet reliable in operation.

SUMMARY OF THE INVENTION

In keeping with the above objects and others which will become apparent hereafter, one feature of the present invention resides in a decorative lighting arrangement that includes a support having an upper region as considered in its position of use, and a lighting fixture including a socket and a light bulb mounted in the socket. According to the present invention, there is further provided means for connecting the lighting fixture to the support in such a manner that the light bulb and at least a predominant portion of the socket of the lighting fixture are disposed upwardly of the upper region of the support to be visible thereat. A particular advantage of the arrangement as described so far is that the socket is not only visible but also easily accessible, for instance for light bulb replacement purposes.

The support is advantageously constituted by an elongated stake having a trailing end portion that constitutes the aforementioned upper region when the stake is driven into the ground in its position of use. In any event, the connecting means includes a coupling element that is connected and preferably integral with the upper region of the support, such as the trailing end portion of the stake.

According to an advantageous aspect of the present invention, the coupling element includes a platform and an upstanding rim peripherally surrounding a portion of the platform. Under these circumstances, the connecting means further includes a coupling portion connected with the socket of the lighting fixture and at least frictionally engaging the platform and the rim of the coupling element of the support to retain the lighting fixture in a position of use thereof on the support.

It is advantageous when the coupling portion includes a bottom portion of a housing of the socket as considered in the position of use. Such bottom portion has a bottom surface that is in contact with the platform in the position of use of the lighting fixture, and respective electric wires emerging from the bottom portion of the housing at opposite sides thereof. The upstanding rim of the coupling element then bounds a recess for receiving the bottom portion of the housing and has respective open-ended slots for introduction of the wires thereinto as the lighting fixture is being assembled with the support, such wires being frictionally retained in the slots following such assembly.

In addition or instead of this, there may be provided a generally hook-shaped projection integral with the bottom portion of the housing and extending upwardly therefrom as considered in the position of use. The upstanding rim of the coupling element has an opening positioned for introduction of the projection thereinto as the lighting fixture is being assembled with the support in an assembling orientation thereof. The projection passes through the opening in the position of use of the lighting fixture following such assembly.

According to another facet of the present invention, the connecting means further includes a decorative element, which may have a star-shaped configuration, having an opening receiving a portion of the lighting fixture. The coupling portion of the connecting means is an integral part of the decorative element constituting a base of the latter at a location remote from the opening. In this context, it is advantageous when the coupling portion includes a bottom wall as considered in the position of use of the decorative element and two upstanding lateral walls flanking the bottom wall at opposite sides thereof, and when the rim of the coupling element of the support includes a cantilevered portion that overhangs the platform and bounds therewith a channel for receiving and guiding the lateral walls of the connecting portion. Last but not necessarily least, the lateral walls of the connecting portion of the decorative element are in frictional engagement with the rim and the platform after assembly of the base of the decorative element with the support.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is a view akin to that of FIG. 1 but showing a modified version of the lighting arrangement;

FIG. 5 is a fragmentary front elevational view of the lighting arrangement of FIG. 4;

FIG. 6 is a sectional view of a coupling region of the modified lighting arrangement, taken on line 6—6 of FIG. 5; and FIG. 7 is a partly cross-sectioned top elevational view of the coupling region of the modified lighting arrangement, taken on line 7—7 of FIG. 5.

DETAILED DESCRIPTION OF THE PREFERRED EMBODIMENT

Figure 1:
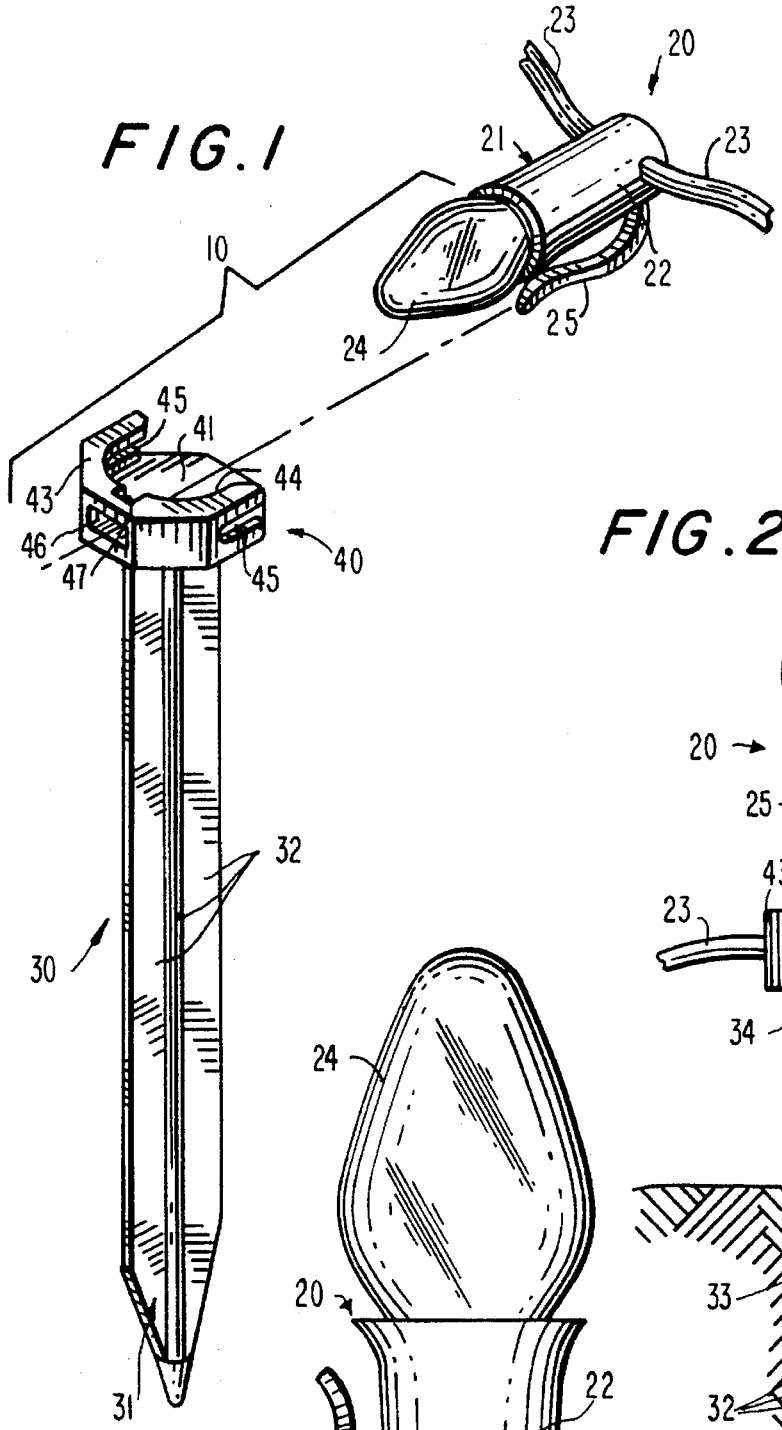
FIG. 1 is a perspective view showing support and lighting fixture components of a decorative lighting arrangement in their disassembled condition.

Referring now to the drawing in detail, and first to FIG. 1 thereof, it may be seen that the reference numeral 10 has been used therein to identify a decorative lighting arrangement of the present invention in its entirety. The lighting arrangement 10 includes, as its basic components, a lighting fixture 20 and an elongated rod-shaped support 30 for supporting the lighting fixture 20.

The lighting fixture 20 includes a socket 21 that, as far as its basic structural and operational characteristics or features are concerned, is of a conventional construction. In accordance with well known principles, the socket 21 includes a housing 22 of an electrically insulating material that accommodates electrical contacts that have insulated electrical conductors or wires 23 respectively connected thereto. Both the construction and configuration of the electric contacts and the manner in which the electrical conductors 23 are connected thereto are well known and, hence, neither have they been illustrated, nor will they be discussed, herein in any detail.

Suffice it to say that one of the contacts may be constituted by an internally threaded sleeve securely held in position within the electrically insulating housing 22. A non-illustrated base of a light bulb 24 is threaded or otherwise introduced into the interior of the housing 22 and is held therein, for instance by the internal thread of the aforementioned sleeve that meshes with a correspondingly configured external thread of the light bulb base, in such a manner that different regions thereof are in electrical contact with the respective contacts. As a result, the light bulb 24 will light up when electric current is supplied to the aforementioned contacts through said wires 23. It may be seen in FIG. I of the drawing that the wires enter the housing 22 through one region of its bottom and leave the housing 22 through an oppositely located region. This indicates that the lighting fixture 20 is a member of a series of such or similar fixtures that are stringed together by the wires 23. All this is also well known so that it need not be elaborated upon.

Figure 2:
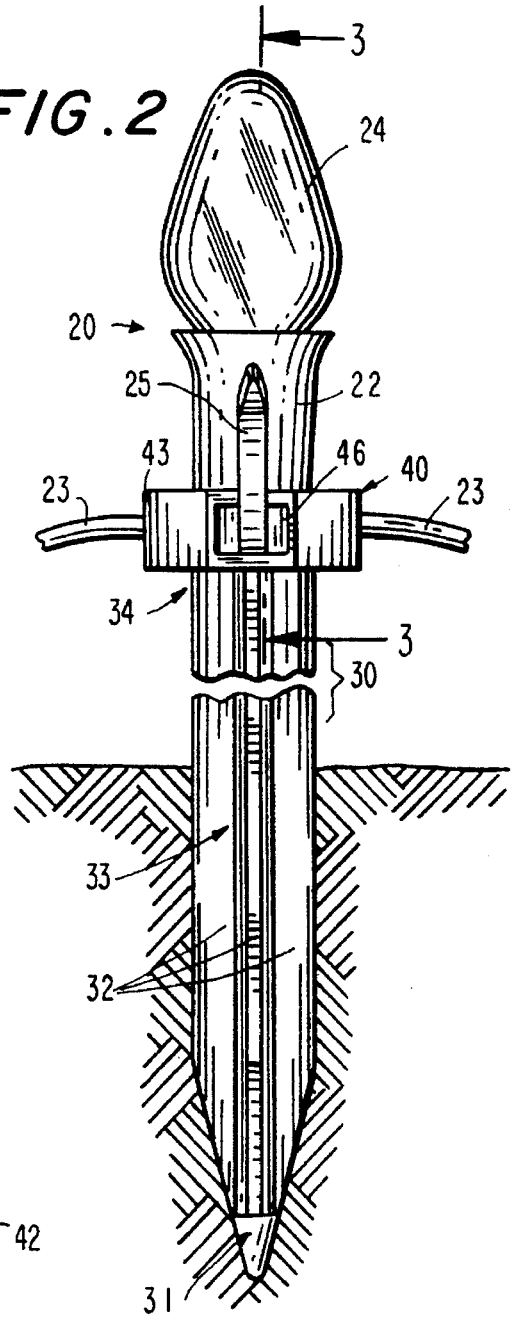
FIG. 2 is a rear elevational view of the lighting arrangement of FIG. 1 in its assembled condition.

The support 30 is illustrated to be designed as a stake that is to be driven into the ground, as may be perceived from FIG. 2. To this end, the elongated support 30 has a tapering leading end portion 31 as considered in the direction in which the support 30 is to be driven into the ground, and includes respective ribs 32 that give a central portion 33 of the support 30 situated intermediate its tapering leading end 31 and its trailing end 34 a cross-shaped cross section. The tapering end 31 and the ribs 32 aid in the displacement of earth out of the way as the support or stake 30 is being driven into the ground, whereas the cross-shaped cross section of the central portion goes a long way toward maximizing the rigidity of the stake 30 for a given amount of material. All this is also known.

What is not known is a unique construction of a coupling 40 that is disposed at and rigidly connected to, preferably integral or of one piece with, the trailing or upper end portion 34 of the support 30. This coupling 40 is designed to cooperate not only with the lighting fixture 30, but also with other lighting fixture constructions, as will be discussed later, thus in effect making the coupling 40 universal or at least multipurpose. The features that confer this property on the coupling 40 will become apparent as the present explanation proceeds. At this juncture, however, the focus will be on those features that make the coupling 40 particularly suited for holding the lighting fixture 20 in position on the support 30.

To begin with, the coupling 40 includes a platform 41 that is enlarged with respect to the central and upper end portions 33 and 34 of the support 30, that is, it has dimensions that exceed the corresponding dimensions of the end portion 34. As may be seen particularly in FIG. 3 of the drawing, the platform 41 has a planar top surface 42 suited for supporting the housing 22 of the socket 21 from below in that a correspondingly configured, i.e. substantially flat, bottom surface of the housing 22 rests thereon as the lighting fixture 20 assumes an upright operative position thereof (shown in FIGS. 2 and 3) on the vertically extending support 30.

The coupling 40 further includes an upstanding rim 43 that extends around a substantial part of the periphery of the platform 41 and defines a recess 44 for receiving the bottom portion of the socket 21 with only a relatively small amount of leeway, if any. The rim 43 has an open lateral portion or mouth through which the socket 21 can be introduced into the recess 44. The rim 43 rises to only a relatively small extent above the upper or top surface 42 of the platform 41, so that a significant or prevalent part of the housing 22 is visible above the same when the socket 21 is in its operative upright position. The rim 43 includes respective oppositely located slots 45 that have respective open ends through which the wires 23 are introduced into and withdrawn from the respective slots 45 during the insertion of the housing 22 into and its retraction from the recess 44, respectively.

Figure 3:
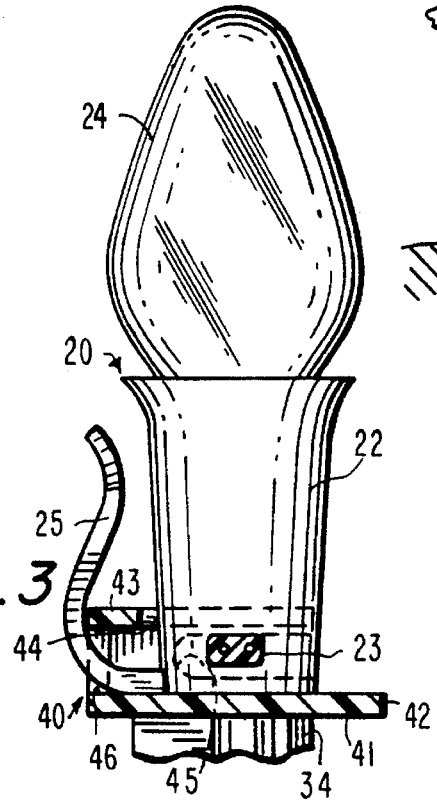
FIG. 3 is a partially sectioned side elevational view, at an enlarged scale, of an end portion of the above lighting arrangement, taken on line 3—3 of FIG. 2.

As may be observed in FIG. 3 of the drawing, the slots 45 are so positioned with respect to the wires 23 that one (the upper) lateral surface of each slot 45 is in contact with the wires 23; preferably, this contact is of the interference type, that is the wires 23, which are flexible as is usual in this context, are elastically bent out of the way during their introduction into the slots 45. This measure results in the socket 21 being pressed against the top surface 42 of the platform 41 and thus being retained in the acquired operational position by friction between itself and the platform 41, as well as between itself and the wires 43.

This frictional retention, however, usually does not give sufficient assurance that the lighting fixture 20 will not become accidentally or inadvertently dissociated from its support 30. Consequently, to alleviate this problem or even avoid it altogether, the housing 22 of the socket 21 is provided with a flexible or resiliently yieldable hook-shaped projection 25 extending upwardly from the bottom region of the housing 22. While the projection 25 is physically an integral part of the housing 22, functionally it is a part of the coupling 40 in that it is designed to engage the rim 43.

To this end, the rim 43 is provided with a through opening 46 that is so positioned that the flexible hook-shaped projection 25 can be easily introduced into and almost entirely pass through this opening 46 as the lighting fixture 20 is being assembled with the support 30 in the relative positions illustrated in FIG. 1. After this phase of the assembly is completed, the fixture 20 is manipulated or maneuvered in such a fashion, with the projection 25 still passing through the opening 46, as to eventually reach its aforementioned upright operating position. This operation involves a certain, albeit minimum, amount of skill, as well as a certain degree of bending of the hook-shaped projection 25, both of which militate against accidental dissociation of the lighting fixture 20 from its support 30. The rim 43 is further provided, at its upper region and in alignment with the opening 46, with a cutout 47 that facilitates the manipulation with the lighting fixture 20 during its assembly with and intentional disassembly from the support 30.

Turning now to FIGS. 4 to 7 of the drawing, it is to be mentioned first that the support 30, its coupling 40, and as to its basic construction, the lighting fixture 20 as well, are identical to those discussed above so that the same reference numerals as before are assigned to these components and their respective parts, and repetitious discussion of their features will not be presented here. Yet, it is to be mentioned here that, as a comparison of FIGS. 4 and 7 will reveal, the rim 43 of the coupling 40 has a cantilevered portion 48 that overhangs the platform 41 to a certain extent so that the rim 43 and the platform 41 form a guiding and holding channel 49 with one another.

In this case, the lighting fixture 20 is not to be mounted directly on the support 30. Rather, it is mounted on a decorative element 50 that, in turn, is to be assembled with the support 30 and connected thereto by the coupling 40. In the illustrated example, the decorative element 50 has a star-shaped configuration reminiscent of the Star of Bethlehem. The decorative element 50 may be of a transparent or translucent material, especially that of a synthetic plastic material variety to reduce if not eliminate the risk of injury, and/or it may be provided with a layer of reflecting material covering a major surface that can be reached by the rays of light emanating from the light bulb 24 when the decorative lighting arrangement, here designated by the reference numeral 10', is in operation.

Without going into unnecessary detail, it is to be mentioned that the lighting fixture 20 is mounted on the decorative element 50 by means of a mounting ring 51 that is received in a substantially centrally disposed through opening of the decorative element 50. The mounting ring 51 has a central opening of a size smaller than both the socket 21 and the light bulb 24. This is usually sufficient to retain the lighting fixture 20 in its mounted position on the decorative element 50 following the introduction of the base of the light bulb 24 into the socket 21 and its securing therein. Of course, the materials of both the mounting ring 51 and the decorative element 50 itself have to be such as not to melt or become otherwise distorted or damaged when exposed to the heat generated by the light bulb 24 during its often extended operation.

As mentioned above, the decorative element 50 is to be connected to the support or stake 30 by the coupling 40. To this end, the decorative element 50 is equipped with a mounting base 52 which, while physically integral with the element 50, once more is functionally a part of the coupling 40. The base 52 includes a bottom wall 53 that is flanked by two upstanding side walls 54 interconnected by a rear wall 55. A substantially triangular rib 56 reinforces the region at which the decorative element 50 proper is connected with the base 52.

As may be seen when FIGS. 6 and 7 of the drawing are considered in conjunction with one another, the upstanding side walls 54 of the base 52 of the decorative element 50 are substantially snugly received in the channel 49 of the coupling 443, that is, they can only be introduced into the channel 49 if moving in alignment therewith in a relative position and direction of the element 50 with respect to the support 30 that are indicated in FIG. 4 of the drawing. Frictional engagement between the top surface 42 of the platform 41 and the bottom surface of the base 52 and/or between the lateral walls 54 and the surfaces bounding the channel 49 securely retains the base 52 and thus the entire decorative element 50 supporting the lighting fixture 50 in position on the support 30.

It will be understood that each of the elements described above, or two or more together, may also find a useful application in other types of constructions differing from the type described above.

While the present invention has been described and illustrated herein as embodied in a specific construction of a multipurpose coupling for connecting differently configured decorations to a stake, it is not limited to the details of this particular construction, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

We claim:

1. A decorative lighting arrangement, comprising:

a) an upright support having an upper region, said support being an elongated stake having a trailing end portion constituting said upper region when said stake is driven into the ground;

b) a lighting fixture including a socket and a light bulb mounted in said socket; and c) means for connecting said lighting fixture to said support in such a manner that said light bulb and at least a predominant portion of said socket of said lighting fixture are disposed upwardly of said upper region of said support to be visible thereat, said connecting means including a coupling element integral with said trailing end portion of said stake, said coupling element including a platform and an upstanding rim peripherally surrounding a portion of said platform;

said connecting means further including a coupling portion connected with said socket of said lighting fixture and at least frictionally engaging said platform and said rim of said coupling element of said stake to retain said lighting fixture on said stake, said coupling portion including a bottom portion of a housing of said socket, said bottom portion having a bottom surface that is in contact with said platform of said lighting fixture, and respective electric wires emerging from said bottom portion of said housing at opposite sides thereof; and said upstanding rim bounding a recess for receiving said bottom portion of said housing and having respective open-ended slots for introduction of said wires thereinto as said lighting fixture is being assembled with said stake, said wires being frictionally retained in said slots following such assembly.

2. A decorative lighting arrangement, comprising:

a) an upright support having an upper region, said support being an elongated stake having a trailing end portion constituting said upper region when said stake is driven into the ground;

b) a lighting fixture including a socket and a light bulb mounted in said socket; and c) means for connecting said lighting fixture to said support in such a manner that said light bulb and at least a predominant portion of said socket of said lighting fixture are disposed upwardly of said upper region of said support to be visible thereat, said connecting means including a coupling element integral with said trailing end portion of said stake, said coupling element including a platform and an upstanding rim peripherally surrounding a portion of said platform;

said connecting means further including a coupling portion connected with said socket of said lighting fixture and at least frictionally engaging said platform and said rim of said coupling element of said stake to retain said lighting fixture on said stake, said coupling portion including a bottom portion of a housing of said socket, said bottom portion having a bottom surface that is in contact with said platform of said lighting fixture, and a generally hook-shaped projection integral with said bottom portion of said housing and extending upwardly therefrom; and said upstanding rim bounding a recess for receiving said bottom portion of said housing and having an opening positioned for introduction of said projection thereinto as said lighting fixture is being assembled with said stake in an assembling orientation thereof, said projection passing through said opening of said lighting fixture following such assembly.

3. A decorative lighting arrangement, comprising:

a) an upright support having an upper region, said support being an elongated stake having a trailing end portion constituting said upper region when said stake is driven into the ground;

b) a lighting fixture including a socket and a light bulb mounted in said socket; and c) memos for connecting said lighting fixture to said support in such a manner that said light bulb and at least a predominant portion of said socket of said lighting fixture are disposed upwardly of said upper region of said support to be visible thereat, said connecting means including a coupling element integral with said trailing end portion of said stake, said coupling element including a platform and an upstanding rim peripherally surrounding a portion of said platform;

said connecting means further including a coupling portion connected with said socket of said lighting fixture and at least frictionally engaging said platform and said rim of said coupling element of said stake to retain said lighting fixture on said stake, said connecting means further including a decorative element having an opening receiving a portion of said lighting fixture, and said coupling portion of said connecting means being an integral part of said decorative element constituting a base of said decorative element at a location remote from said opening, said base including a bottom wall of the decorative element and two upstanding lateral walls flanking said bottom wall at opposite sides thereof; and said rim of said coupling element of said stake including a cantilevered portion that overhangs said platform and bounding therewith a channel for receiving and guiding said lateral walls.

4. The decorative lighting arrangement as defined in claim 3, wherein said lateral walls of said connecting portion of said decorative element are in frictional engagement with said rim and said platform after assembly of said base of said decorative element with said support.

5. The decorative lighting arrangement as defined in claim 3, wherein said decorative element has a star-shaped configuration.

6. A decorative lighting arrangement, comprising:

a) an upright support having an upper region;

b) a lighting fixture including a socket and a light bulb mounted in said socket; and c) means for connecting said lighting fixture to said support in such a manner that said light bulb and at least a predominant portion of said socket of said lighting fixture are disposed upwardly of said upper region of said support to be visible thereat, said connecting means including a coupling element integral with said upper portion of said support and including a platform and an upstanding rim peripherally surrounding a portion of said platform;

said connecting means further including a coupling portion connected with said socket of said lighting fixture and at least frictionally engaging said platform and said rim of said coupling element of said support to retain said lighting fixture on said support, said coupling portion including a bottom portion of a housing of said socket, said bottom portion having a bottom surface that is in contact with said platform of said lighting fixture, and respective electric wires emerging from said bottom portion of said housing at opposite sides thereof; and said upstanding rim bounding a recess for receiving said bottom portion of said housing and having respective open-ended slots for introduction of said wires thereinto as said lighting fixture is being assembled with said support, said wires being frictionally retained in said slots following such assembly.

7. A decorative lighting arrangement, comprising:

a) an upright support having an upper region;

b) a lighting fixture including a socket and a light bulb mounted in said socket; and c ) means for connecting said lighting fixture to said support in such a manner that said light bulb and at least a predominant portion of said socket of said lighting fixture are disposed upwardly of said upper region of said support to be visible thereat, said connecting means including a coupling element integral with said upper portion of said support and including a platform and an upstanding rim peripherally surrounding a portion of said platform;

said connecting means further including a coupling portion connected with said socket of said lighting fixture and at least frictionally engaging said platform and said rim of said coupling element of said support to retain said lighting fixture on said support, said coupling portion including a bottom portion of a housing of said socket, said bottom portion having a bottom surface that is in contact with said platform of said lighting fixture, and a generally hook-shaped projection integral with said bottom portion of said housing and extending upwardly therefrom; and said upstanding rim bounding a recess for receiving said bottom portion of said housing and having an opening positioned for introduction of said projection thereinto as said lighting fixture is being assembled with said support in an assembling orientation thereof, said projection passing through said opening of said lighting fixture following such assembly.

8. A decorative lighting arrangement, comprising:

a) an upright support having an upper region;

b) a lighting fixture including a socket and a light bulb mounted in said socket; and c) means for connecting said lighting fixture to said support in such a manner that said light bulb and at least a predominant portion of said socket of said lighting fixture are disposed upwardly of said upper region of said support to be visible thereat, said connecting means including a coupling element integral with said upper portion of said support and including a platform and an upstanding rim peripherally surrounding a portion of said platform;

said connecting means further including a coupling portion connected with said socket of said lighting fixture and at least frictionally engaging said platform and said rim of said coupling element of said support to retain said lighting fixture on said support, said connecting means further including a decorative element having an opening receiving a portion of said lighting fixture; and said coupling portion of said connecting means being an integral part of said decorative element constituting a base of said decorative element at a location remote from said opening, said base including a bottom wall of the decorative element and two upstanding lateral walls flanking said bottom wall at opposite sides thereof; and said rim of said coupling element of said support including a cantilevered portion that overhangs said platform and bounding therewith a channel for receiving and guiding said lateral walls.

9. The decorative lighting arrangement as defined in claim 8, wherein said decorative element has a star-shaped configuration.

10. The decorative lighting arrangement as defined in claim 8, wherein said lateral walls of said connecting portion of said decorative element are in frictional engagement with said rim and said platform after assembly of said base of said decorative element with said support.

* * * * *